US007893901B2

(12) United States Patent
Kang

(10) Patent No.: US 7,893,901 B2
(45) Date of Patent: Feb. 22, 2011

(54) APPARATUS AND METHOD FOR DRIVING A HOLD-TYPE DISPLAY PANEL

(75) Inventor: Won-sik Kang, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 957 days.

(21) Appl. No.: 11/745,812

(22) Filed: May 8, 2007

(65) Prior Publication Data

US 2007/0262943 A1 Nov. 15, 2007

(30) Foreign Application Priority Data

May 9, 2006 (KR) ..... 10-2006-0041627

(51) Int. Cl.
*G09G 3/36* (2006.01)

(52) U.S. Cl. ..... 345/87; 345/99

(58) Field of Classification Search ..... 345/55–100, 345/204–214, 690–697
See application file for complete search history.

(56) References Cited

U.S. PATENT DOCUMENTS

| | | | | |
|---|---|---|---|---|
| 5,867,141 | A * | 2/1999 | Asada et al. | 345/100 |
| 5,883,609 | A * | 3/1999 | Asada et al. | 345/100 |
| 6,473,077 | B1 * | 10/2002 | Takenaka et al. | 345/209 |
| 7,161,576 | B2 * | 1/2007 | Kawabe et al. | 345/99 |
| 7,173,594 | B2 * | 2/2007 | Nakamura et al. | 345/98 |
| 2004/0183792 | A1 * | 9/2004 | Takada et al. | 345/204 |
| 2004/0189583 | A1 | 9/2004 | Park et al. | |
| 2008/0170017 | A1 * | 7/2008 | Jeoung et al. | 345/87 |

FOREIGN PATENT DOCUMENTS

| | | |
|---|---|---|
| JP | 2005-004085 | 1/2005 |
| KR | 1020040052348 | 6/2004 |
| KR | 1020040077012 | 9/2004 |
| KR | 1020050079719 | 8/2005 |

OTHER PUBLICATIONS

English Abstract for Publication No. 1020040052348.
English Abstract for Publication No. 1020040077012.
English Abstract for Publication No. 2005-004085.
English Abstract for Publication No. 1020050079719.

* cited by examiner

*Primary Examiner*—Nitin Patel
(74) *Attorney, Agent, or Firm*—F. Chau & Associates, LLC

(57) ABSTRACT

An apparatus and method for driving a hold-type display panel, for example an LCD (liquid crystal display) panel, includes gate lines and data lines intersecting to form a matrix of pixels. An image is displayed corresponding to data signals applied to the data lines according to gate pulses applied to the gate lines. A signal controlling unit generates a gate control signal for selecting the gate lines and image data to be displayed. The signal controlling unit also generates predetermined dummy data during a dummy data display interval set within a blank interval of a vertical synchronization signal. A gate driving unit applies the gate pulses to the gate lines selected according to the gate control signal. A data driving unit generating the data signal corresponding to the image data and applies the data signals to corresponding data lines.

19 Claims, 4 Drawing Sheets

APPARATUS AND METHOD FOR DRIVING A HOLD-TYPE DISPLAY PANEL

CROSS-REFERENCE TO RELATED PATENT APPLICATION

This application claims priority to Korean Patent Application No. 10-2006-0041627, filed on May 9, 2006, in the Korean Intellectual Property Office, the disclosure of which is hereby incorporated by reference in its entirety.

BACKGROUND OF THE INVENTION

1. Technical Field

The present disclosure relates to a display panel, and more particularly, to an apparatus and method for driving a hold-type display panel.

2. Discussion of the Related Art

U.S. Patent Application Publication No. 2004-0189583 relates to a technique for display where black data is inserted during a vertical blanking section and, simultaneously, a plurality of gate bus lines are scanned. The time required to drive all gates during a blanking section is thereby reduced. Korean Patent Application Publication No. 2005-079719 relates to a technique for displaying an image with a display apparatus. The order of applying gate-on voltages between adjacent frames when the gate-on voltages are applied to gate lines is reversed. A data signal is thereby changed according to the order of frames.

Display devices may be classified as a hold-type display device which displays a continuous image during one frame, or an impulse-type display device which displays an image during a short scanning period of time included in one frame. An example of the hold-type display device includes a liquid crystal display (LCD). An example of the impulse-type display device includes a cathode-ray tub (CRT).

LCDs include two display substrates on which pixel electrodes and common electrodes are arranged respectively. A liquid crystal layer is interposed between the two display substrates. The liquid crystal layer has dielectric anisotropy. The pixel electrodes are arranged in a matrix, and are connected to switching devices, for example, thin film transistors (TFTs). The pixel electrodes sequentially receive a data voltage from the switching devices. The common electrodes are arranged on the entire surface of the display substrate and a common voltage is applied thereto. The liquid crystal layer between the pixel electrodes and the common electrodes can be represented by liquid crystal capacitors in an equivalent circuit. Each liquid crystal capacitor forms a pixel, together with a switching device connected to the liquid crystal capacitor.

In an LCD, an electric field is generated in the liquid crystal layer by applying the voltage of the data signal and a common voltage to the pixel electrodes and the common electrodes, respectively. The transmissivity of light passing through the liquid crystal layer is controlled by adjusting the intensity of the electric field, whereby a desired image can be obtained.

However, hold-type display devices, such as LCDs, provide a response speed that is significantly lower than the response speed of an impulse-type display device, and thus are difficult to use to display moving pictures. Therefore, hold-type display devices may retain an afterimage when displaying moving images.

Accordingly, when a moving object is displayed with conventional LCDs, an image is seen as viewed through a stroboscope. Additionally, when similar gray scales are displayed in close proximity, colors and brightness of the gray scales are mixed due to the movement of the gray scales.

SUMMARY OF THE INVENTION

Exemplary embodiments of the present invention provide an apparatus and method for driving a hold-type display panel. Dummy data is inserted in a blank interval of an image signal and the generation of an afterimage on the screen of the display panel is reduced.

Exemplary embodiments of the present invention provide a computer-readable recording medium which records a computer program for executing the method.

According to an exemplary embodiment of the present invention, an apparatus for driving a hold-type display panel includes a liquid crystal display (LCD) panel. The LCD panel comprising a plurality of gate lines and a plurality of data lines that intersect each other forming a matrix of pixels. An image is displayed on the pixels by applying data signals to the data lines according to gate pulses applied to the gate lines. A signal controlling unit generates a gate control signal for selecting the gate lines and image data to be displayed on the LCD elements. The signal controlling unit also generates predetermined dummy data during a dummy data display interval set within a blank interval of a vertical synchronization signal. A gate driving unit applies the gate pulses to the gate lines selected according to the gate control signal. A data driving unit generating the data signal corresponding to the image data and applies the data signals to corresponding data lines.

The signal controlling unit may generate the gate control signal that simultaneously selects the gate lines and the dummy data is displayed on the pixels during the dummy data display interval.

The dummy data may be identical for each of the pixels. The dummy data may be determined to display black or gray.

The signal controlling unit generates the gate control signal. The gate control signal shifts a gate line by a predetermined number of lines for a successive frame. In each frame, the gate lines are sequentially selected from an initially selected gate line to a last gate line and from a first gate line to a gate line immediately prior to the initially selected gate line.

According to an exemplary embodiment of the present invention, a method of driving a hold-type display panel includes generating predetermined dummy data to be displayed during a dummy data display interval set within a blank interval of a vertical synchronization signal. Control signals for displaying the dummy data are generated.

According to an exemplary embodiment of the present invention, a computer-readable recording medium stores a program for executing a process of generating predetermined dummy data to be displayed during a dummy data display interval set within a blank interval of a vertical synchronization signal and a process of generating control signals for displaying the dummy data.

BRIEF DESCRIPTION OF THE DRAWINGS

The above and other features of the present disclosure will become more apparent by describing in detail exemplary embodiments of the present invention with reference to the attached drawings in which.

DETAILED DESCRIPTION OF THE EXEMPLARY EMBODIMENTS

Exemplary embodiments of the present invention will now be described more fully with reference to the accompanying drawings.

For convenience of explanation, a liquid crystal display (LCD) device is selected as an example of a hold-type display device, however, it is to be understood that the exemplary embodiments of the present invention described below may be applied to other forms of hold-type display devices such as plasma display panels. An operation of the LCD device will now be described.

Figure 1:
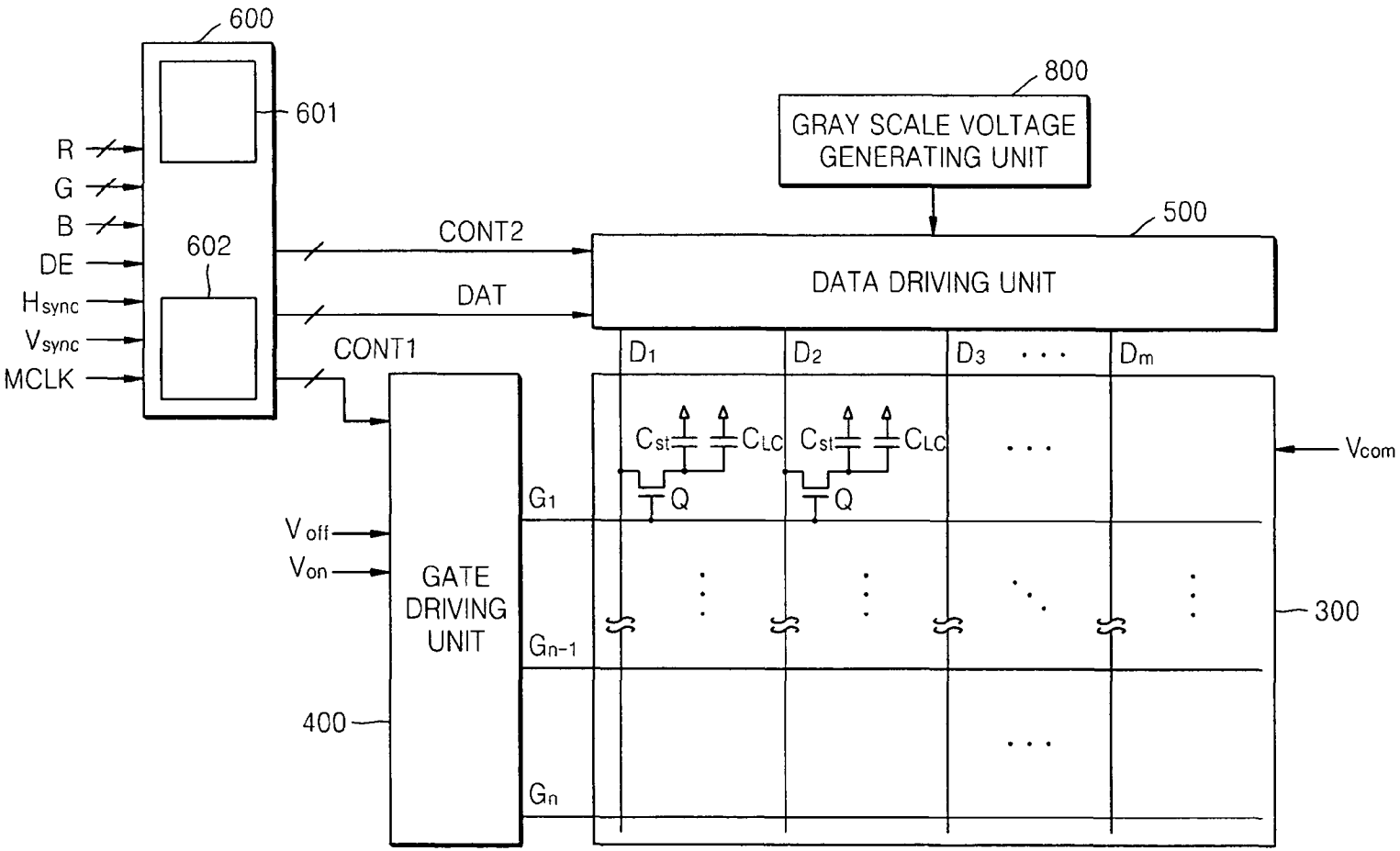
FIG. 1 is a block diagram of a liquid crystal display (LCD) panel driving apparatus according to an exemplary embodiment of the present invention.
Figure 2:
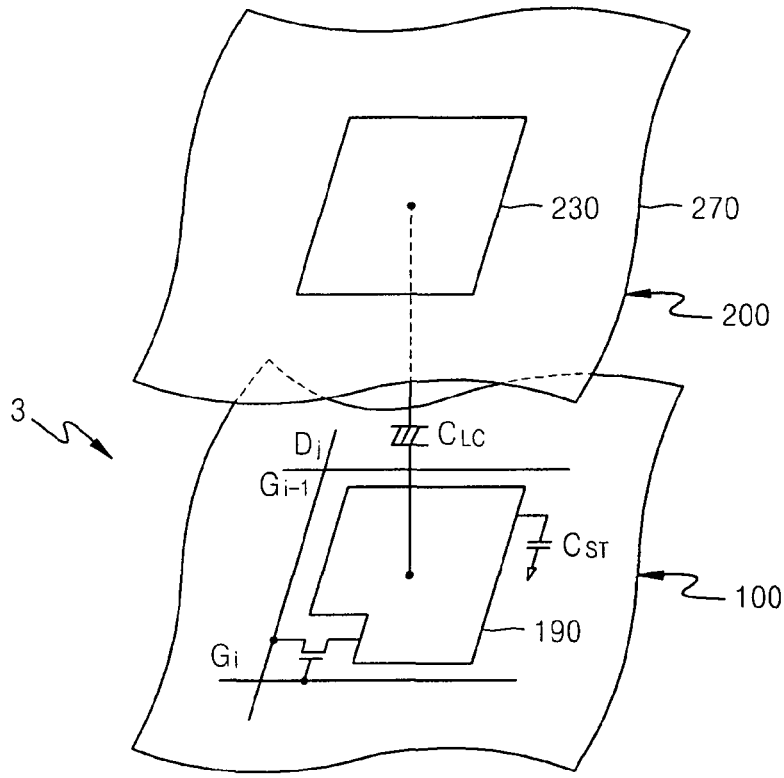
FIG. 2 is a circuit diagram of a pixel element of the LCD panel shown in FIG. 1.

FIG. 1 is a block diagram of an LCD panel driving apparatus according to an exemplary embodiment of the present invention. FIG. 2 is an equivalent circuit diagram of an LCD element of a unit pixel of an LCD panel 300 shown in FIG. 1.

As illustrated in FIG. 1, the LCD panel driving apparatus includes the LCD panel 300, a gate driving unit 400, a data driving unit 500, a gray-scale voltage generation unit 800 connected to the data driving unit 500, and a signal controlling unit 600 controlling the gate driving unit 400 and the data driving unit 500. The gate driving unit 400 and the data driving unit 500 are connected to the LCD panel 300.

When represented by an equivalent circuit, the LCD panel 300 includes a plurality of display signal lines $G_1$-$G_n$ and $D_1$-$D_m$, and LCD elements that are arranged in a matrix and connected to the display signal lines $G_1$-$G_n$ and $D_1$-$D_m$. As illustrated in FIG. 2, each of the LCD elements structurally includes a lower display plate 100, an upper display plate 200, and a liquid crystal layer 3 interposed between the lower and upper display plates 100 and 200.

The display signal lines $G_1$-$G_n$ and $D_1$-$D_m$ include a plurality of gate lines $G_1$-$G_n$ for transmitting a gate signal, and a plurality of data lines $D_1$-$D_m$ for transmitting a data signal. The gate lines $G_1$-$G_n$ are arranged in parallel rows, and the data lines $D_1$-$D_m$ are arranged in parallel columns.

Equivalent circuits representing pixels include switching devices Q are connected to the display signal lines $G_1$-$G_n$ and $D_1$-$D_m$, and liquid crystal capacitors $C_{LC}$ and sustain capacitors $C_{ST}$ are connected to the switching devices Q. The sustain capacitors $C_{ST}$ are optional and may be omitted.

The switching devices Q may be thin film transistors (TFTs) on the lower display plate 100, have control terminals and input terminals connected to the gate lines $G_1$-$G_n$ and the data lines $D_1$-$D_m$, respectively, and output terminals connected to the liquid crystal capacitors $C_{LC}$ and the sustain capacitors $C_{ST}$.

Each of the liquid crystal capacitors $C_{LC}$ uses, as two terminals, a pixel electrode 190 on the lower display plate 100 and a common electrode 270 on the upper display plate 200. The liquid crystal layer 3 between the pixel electrode 190 and common electrodes 270 serves as a dielectric. The pixel electrodes 190 are connected to the switching devices Q. The common electrode 270 is formed on the entire surface of the upper display plate 200 and a common voltage $V_{com}$ is applied thereto. As an alternative to the exemplary embodiment shown on FIG. 2, the common electrode 270 may be formed on the lower display plate 100. In this case, the two electrodes 190 and 270 are each in the shape of lines or bars.

To achieve color display, each pixel displays only one color of a predetermined number of primary colors (i.e., spatial division), or displays different primary colors at different times (i.e., time division). This spatial or temporal sum of the colors leads to a desired color display. FIG. 2, which is an example of spatial division, illustrates each pixel including a color filter 230 in an area facing a pixel electrode 190. The colors of the color filters 230 may be of three colors, namely, red, green, and blue that are the three additive primary colors of light, or four colors obtained by adding white to the three primary colors. Alternatively, the colors of the color filters 230 may be of three subtractive primary colors of cyan, magenta, and yellow. In contrast with FIG. 2, the color filters 230 may be formed above or below the pixel electrodes 190 of the lower display plate 100.

A polarizer (not shown) that polarizes light is attached to the outside surface of one of the two display plates 100 and 200 of the LCD panel 300.

The gray-scale voltage generation unit 800 generates gray-scale voltages associated with the transmissivity of the LCD elements (pixels).

The gate driving unit 400 is connected to the gate lines $G_1$-$G_n$ of the LCD panel 300 and thus applies to the gate lines $G_1$-$G_n$ gate pulse signals $g_1$-$g_n$ (shown in FIG. 4) including pulses produced by combining an external gate-on voltage Von and an external gate-off voltage Voff.

The data driving unit 500 is connected to the data lines $D_1$-$D_m$ of the LCD panel 300 and selects a gray-scale voltage corresponding to a data signal from the gray-scale voltages of the gray-scale voltage generation unit 800 and applied the selected gray-scale voltage to a corresponding data line.

Figure 5:
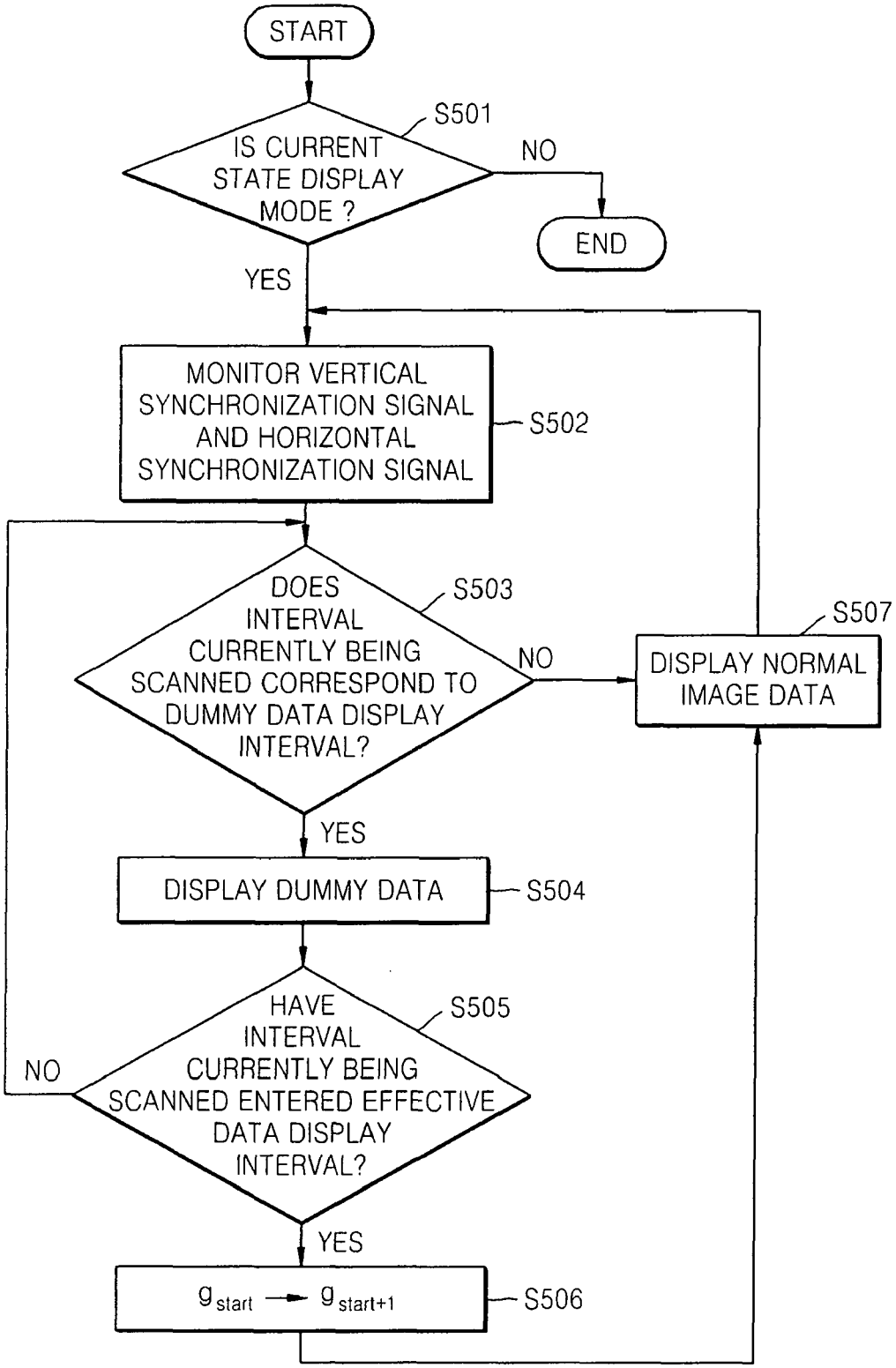
FIG. 5 is a flowchart illustrating an LCD panel driving method according to an exemplary embodiment of the present invention performed in the LCD panel driving apparatus of FIG. 1.

The signal controlling unit 600 includes a frame memory 601 and a dummy data generator 602, and performs a control process as illustrated in FIG. 5. The control process generates a gate control signal for selecting gate lines and image data and generates dummy data in a dummy data display interval DDT set with a blank interval BT of a vertical synchronization signal.

Figure 4:
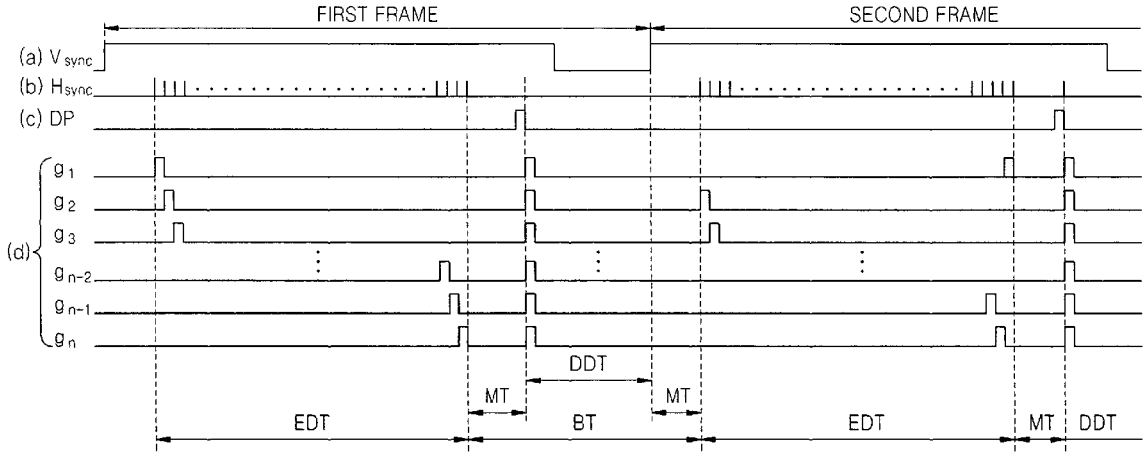
FIG. 4 is a timing diagram of major signals for dummy data display according to an exemplary embodiment of the present invention.

As illustrated in FIG. 4, the dummy data display interval DDT is set within the blank interval BT, and a buffering blank interval MT is interposed between the dummy data display interval DDT and an effective data display interval EDT. The signal controlling unit 600 generates a gate control signal for simultaneously selecting the gate lines at least once so that dummy data is displayed on the pixels during the dummy data display interval DDT.

An image display operation of the LCD of FIG. 1 is described in detail below.

Figure 3:
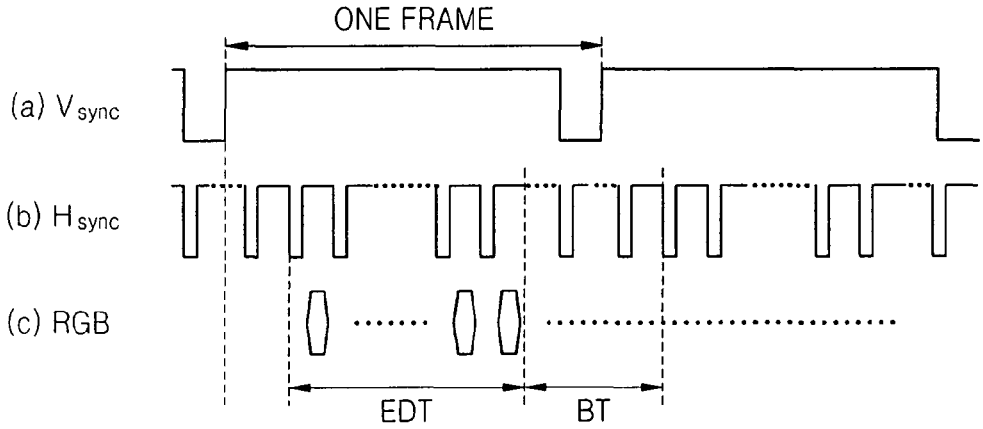
FIG. 3 illustrates waveforms of a vertical synchronization signal and a horizontal synchronization signal with respect to image signal data as applied to an exemplary embodiment of present invention.

As illustrated in FIG. 3, when a vertical synchronization signal Vsync for one frame and a horizontal synchronization signal Hsync for one frame are applied to the signal controlling unit 600, the signal controlling unit 600 sequentially receives image signals R, G, and B each corresponding to one frame in synchronization with the vertical and horizontal synchronization signals. At his time, the image signals R, G, and B are not applied to the signal controlling unit 600 during a low level pulse of the vertical synchronization signal illustrated in FIG. 3 (*a*). As such, a blank interval BT exists in which a part of a generation interval of a vertical synchronization signal is included and the normal image signals R, G, and B are not applied, and an effective data display interval EDT exists in which the normal image signals R, G, and B are applied.

The signal controlling unit 600 receives the image signals R, G, and B and input control signals for controlling the display of the image signals, from an external graphic controller (not shown). The input control signals are the vertical synchronization signal Vsync, the horizontal synchronization signal Hsync, a main clock MCLK, a data enable signal DE, etc. Based on the image signals R, G, and B and the input control signals, the signal controlling unit 600 processes the image signals R, G, and B so that the image signals are suitable for the resolution of the LCD panel 300, and stores a result of the processing in the frame memory 601. The signal controlling unit 600 generates control signals, for example, a gate control signal CONT1 and a data control signal CONT2, and outputs the gate control signal CONT1 to the gate driving unit 400 and the data control signal CONT2 and an image signal DAT to the data driving unit 500. During an effective data display interval EDT, the image data signal DAT becomes normal image data that is read out from the frame memory 601 and corresponds to gate lines to be scanned. During a dummy data display interval DDT of a blank interval BT, the image data signal DAT becomes dummy data with a single level produced by the dummy data generator 602. The dummy data may be set to be black data or gray data.

The gate control signal CONT1 includes a gate line selection signal for sequentially enabling the gate lines during effective data display intervals EDT, a clock signal, an output enable signal for limiting the duration of a gate-on voltage Von, etc. In particular, the gate control signal CONT1 includes a control signal DP that controls the gate-on voltage Von to be generated on the gate lines simultaneously during the dummy data display intervals DDT of the blank intervals BT.

the data control signal CONT2 includes the horizontal synchronization signal Hsync informing the start of the input of the image data signal DAT, a road signal commanding application of corresponding data voltages to the data lines $D_1$-$D_m$, an inversion signal inverting the polarity of a data voltage with respect to the common voltage Vcom, a data clock signal, etc.

the data driving unit 500 sequentially receives and shifts normal image data or dummy data for displaying a column of pixels according to the data control signal CONT2 output by the signal controlling unit 600, selects gray scale voltages corresponding to the image data signal DAT from among the gray scale voltages generated by the gray-scale voltage generation unit 800, and applies the selected gray-scale voltages to corresponding data lines.

The gate driving unit 400 applies the gate-on voltage Von to the gate lines $G_1$-$G_n$ according to the gate control signal CONT1 output by the signal controlling unit 600. As illustrated in FIG. 4, gate pulse signals $g_1$-$g_n$ are generated during the effective data display interval EDT of a first frame according to the gate control signal CONT1, and thus the gate-on voltages Von are applied to the gate lines $G_1$-$G_n$ sequentially from the gate line $G_1$ to the gate line $G_n$. In particular, when receiving the control signal DP from the signal controlling unit 600 during the dummy data display interval DDT, the gate driving unit 400 generates the gate-on voltages Von and simultaneously applies the same to the gate lines $G_1$-$G_n$.

The switching devices Q connected to the gate lines $G_1$-$G_n$ are electrically activated by the gate-on voltages Von. The data voltages applied to the data lines $D_1$-$D_m$ are applied to the LCD elements (pixels) via the electrically activated switching devices Q.

Accordingly, differences between data voltages applied to the LCD elements (pixels) of gate lines to which the gate-on voltages Von have been applied and the common voltage $V_{com}$ are represented as charging voltages (i.e., pixel voltages) of the liquid crystal capacitors $C_{LC}$. Hence, a configuration of the liquid crystal particles of the LCD elements varies according to the sizes of the pixel voltages. The polarization of light that passes through the liquid crystal layer 3 is accordingly changed. The polarization change leads to a change of the transmissivity of light through both of the polarizers (not shown) attached to the display plates 100 and 200, and an image is displayed.

By sequentially applying gate-on voltages Von to the gate lines $G_1$-$G_n$ for one frame as described above, the pixels can be displayed. After one frame, the next frame starts, and the state of an inversion signal that is applied to the data driving unit 500 is controlled so that the polarity of the voltage of the image data signal applied to the LCD element of each pixel is opposite to that of the previous frame.

As described above, the signal controlling unit 600 outputs not only the normal image data but also the dummy data generated by the dummy data generator 602 as the image data signal DAT to the data driving unit 500 during the dummy data display intervals DDT of the blank intervals BT. The signal controlling unit 600 also outputs the control signal DP, for generating the gate-on voltages Von on the gate lines during the dummy data display intervals DDT, to the gate driving unit 400. Thus, dummy data can be displayed during the dummy data display intervals DDT included in the blank intervals BT.

The signal controlling unit 600 increases an initially selected gate line $G_{start}$ by 1 when the frame is changed. For example, as illustrated in FIG. 4(*d*), in a first frame, the scanning commences with a first gate line $G_1$ and the scanning is finished on the last gate line $G_n$. However, in a second frame, the scanning commences with a second gate line $G_2$, the scanning continues up to the last gate line $G_n$, and the scanning finishes on the first gate line $G_1$. In this manner, when the frame is changed, the initially selected gate line is increased by one line.

As described above, a difference between brightness of lines due to simultaneous display of the dummy data on all of the gate lines during each of the blank intervals is prevented by shifting the initially selected gate line when the frame is changed. For example, when the gate line initially selected when the frame is changed is not shifted, a difference between the data display durations of the lines is generated due to the display of dummy data. Hence, a difference between the data display durations of the first gate line and the last gate line is generated, resulting in a difference between the brightness of an upper area and a lower area of a screen.

However, when the gate line initially selected when the frame is changed is shifted, the display durations of the lines become identical and no differences between the brightness of the upper and lower areas of a screen are generated.

A method of driving a hold-type display panel according to an exemplary embodiment of the present invention will now be described with reference to FIG. 5.

The signal controlling unit 600 determines whether a current state is a display mode (Step S501). For example, it may be determined whether the logic state of a data enable signal DE is a display mode.

When it is determined that the current state is a display mode (Yes, Step S501), the signal controlling unit 600 monitors the vertical synchronization signal and the horizontal synchronization signal to identify the interval being scanned (Step S502).

Using the result of the monitoring of Step S502, it is determined whether the interval currently being scanned is a dummy data display interval DDT (Step S503). The dummy data display interval DDT is set within a blank interval, and a buffering blank interval MT is set between the dummy data display interval DDT and the effective data display interval EDT.

When it is determined that the interval currently being scanned corresponds to the dummy data display interval DDT (Yes, Step S503), a control operation is performed to display dummy data (Step S504). For example, the signal controlling unit 600 controls the dummy data generator 602 to generate the dummy data. The dummy data may be determined to display black. Alternatively, the dummy data may be determined to display gray according to the design. The signal controlling unit 600 also generates a gate control signal that simultaneously selects all of the gate lines so that the dummy data is displayed on all of the pixels at least once during a dummy data display interval.

After the process of displaying the dummy data during the blank interval, it is determined whether the location of the interval being scanned has entered an effective data display interval (Step S505).

When it is determined that the interval currently being scanned has not entered the effective data display interval (No, Step S505), the method is returned to operation S503.

When it is determined that the location of the area currently being scanned has entered the effective data display interval (Yes, Step S505), a gate line $G_{start}$ initially selected in a new frame is shifted by a predetermined number of lines when the frame is changed (Step S506). For example, an initially selected gate line $G_{start}$ is increased by 1 when the frame is changed. For example, a first frame scanning commences with a first gate line $G_1$ and the scanning is finished on the last gate line $G_n$. However, if a second frame scanning commences with a second gate line $G_2$, the scanning continues up to the last gate line $G_n$, and the scanning finishes on the first gate line $G_1$. During a third frame, scanning starts on a third gate line $G_3$ and sequentially continues up to the last gate line $G_n$. The first gate line $G_1$ is scanned, and the scanning is finished on the second gate line $G_2$. In this manner, when the frame is changed, the initially selected gate line is shifted by one line.

After Step S506, a process of displaying normal image data in a sequence from the normal image data of the initially selected gate line to the normal image data of a corresponding gate line is executed (Step S507).

When it is determined that the interval currently being scanned does not correspond to the dummy data display interval DDT (No, Step S503), normal image data of a gate line selected during the effective data display interval is displayed on the LCD elements (Step S507).

As described above, in an operation of a hold-type display panel according to an exemplary embodiment of the present invention, dummy data is inserted into multiple gate lines simultaneously during a blank interval of an image signal. An initially selected gate line is shifted when the frame is changed. Accordingly, an afterimage generated on a hold-type display panel can be reduced, and generation of a difference between brightness of areas on a screen due to the insertion of the dummy data can be prevented.

Exemplary embodiments of the present invention may be implemented as a method, an apparatus, and a system. When exemplary embodiments of the present invention are implemented in software, its component elements are code segments for executing operations. Programs or code segments can be stored in processor readable media and can be transmitted via a computer data signal that is combined with a carrier wave in a transmission medium or in a communication network. The processor readable medium can be any medium that can store or transmit data. Examples of the processor readable medium include electronic circuits, semiconductor memory devices, ROMs, flash memories, erasable ROMs (EROMs), floppy disks, optical disks, hard disks, optical fibers, radio frequency (RF) networks, etc. The computer data signal can be any signal that can be transmitted via transmission media, such as electronic network channels, optical fibers, air, an electronic field, RF networks, etc.

While the present disclosure has been particularly shown and described with reference to exemplary embodiments of the present invention, it will be understood by those of ordinary skill in the art that various changes in form and details may be made without departing from the spirit and scope of the present invention.

What is claimed is:

1. An apparatus for driving a hold-type display panel, the apparatus comprising:

an LCD (liquid crystal display) panel comprising a plurality of gate lines and a plurality of intersecting data lines forming a matrix of pixels displaying an image corresponding to data signals applied to the data lines according to gate pulses applied to the gate lines;

a signal controlling unit generating a gate control signal for selecting the gate lines and image data to be displayed on the LCD panel and generating predetermined dummy data during a dummy data display interval set within a blank interval of a vertical synchronization signal;

a gate driving unit applying selected gate pulses to the gate lines; and a data driving unit generating the data signals corresponding to the image and applying the data signals to corresponding data lines, wherein the signal controlling unit shifts the selected gate line by a predetermined number of gate lines to a shifted gate line when a frame is changed when it is determined that a location of an area currently being scanned has entered an effective data display interval and the gate driving unit subsequently applies the selected gate pulses to the shifted gate line rather than to the originally selected gate line, and when the shift of the predetermined number of gate lines is such that the selected gate line is shifted past a final gate line, shifting is continued from a first gate line.

2. The apparatus of claim 1, wherein the signal controlling unit generates the gate control signal for simultaneously selecting all of the gate lines and the dummy data is displayed on all of the pixels during the dummy data display interval.

3. The apparatus of claim 1, wherein the dummy data for all of the pixels is identical.

4. The apparatus of claim 1, wherein the dummy data is predetermined to display black.

5. The apparatus of claim 1, wherein the dummy data is predetermined to display gray.

6. The apparatus of claim 1, wherein the dummy data display interval is set within the blank interval such that a buffering blank interval exists between the dummy data display interval and an effective data display interval.

7. The apparatus of claim 1, wherein the predetermined number of lines is one line.

8. A method of driving a hold-type display panel, the method comprising:

generating predetermined dummy data to be displayed during a dummy data display interval set within a blank interval of a vertical synchronization signal; and generating control signals for displaying the dummy data wherein a selected gate line is shifted by a predetermined number of gate lines to a shifted gate line when a frame is changed when it is determined that a location of an area currently being scanned has entered an effective data display interval and pulses intended to be applied to the selected hate line are instead applied to the shifted gate line, and when the shift of the predetermined number of gate lines is such that the selected gate line is shifted past a final gate line, shifting is continued from a first gate line.

9. The method of claim 8, wherein the control signals comprise a gate control signal that selects one or more gate lines of the display panel such that the dummy data is displayed on all pixels of the display panel during the dummy data display interval.

10. The method of claim 8, wherein the control signals comprise a gate control signal that simultaneously selects all gate lines such that the dummy data is displayed on all pixels of the display panel during the dummy data display interval.

11. The method of claim 8, wherein the dummy data display interval is set within the blank interval such that a buffering blank interval exists between the dummy data display interval and an effective data display interval.

12. The method of claim 8, wherein identical dummy data is displayed on all pixels of the display panel.

13. The method of claim 8, wherein the dummy data is predetermined to display black.

14. The method of claim 8, wherein the dummy data is predetermined to display gray.

15. The method of claim 8, wherein the predetermined number of lines is one line.

16. A computer-readable recording medium which records a program for executing a process of generating predetermined dummy data to be displayed during a dummy data display interval set within a blank interval of a vertical synchronization signal and a process of generating control signals for displaying the dummy data wherein a selected gate line is shifted by a predetermined number of gate lines to a shifted gate line when a frame is changed when it is determined that a location of an area currently being scanned has entered an effective data display interval and pulses intended to be applied to the selected hate line are instead applied to the shifted gate line, and when the shift of the predetermined number of gate lines is such that the selected gate line is shifted past a final gate line, shifting is continued from a first gate line.

17. The computer-readable recording medium of claim 16, wherein the control signals comprise a gate control signal that selects one or more gate lines of a display panel such that the dummy data is displayed on all pixels of the display panel during the dummy data display interval.

18. The computer-readable recording medium of claim 16, wherein the control signals comprise a gate control signal that simultaneously selects all gate lines of a display panel such that the dummy data is displayed on all pixels of the display panel during the dummy data display interval.

19. The computer-readable recording medium of claim 16, wherein the dummy data display interval is set within the blank interval such that a buffering blank interval exists between the dummy data display interval and an effective data display interval.

* * * * *